United States Patent [19]

Diefendorf et al.

[11] Patent Number: 4,465,586

[45] Date of Patent: Aug. 14, 1984

[54] FORMATION OF OPTICALLY ANISOTROPIC PITCHES

[75] Inventors: Russell J. Diefendorf, Clifton Park, N.J.; Joe G. Venner, Milton, Canada

[73] Assignee: Exxon Research & Engineering Co., Florham Park, N.J.

[21] Appl. No.: 388,017

[22] Filed: Jun. 14, 1982

[51] Int. Cl.[3] ..... C10C 1/20; C10C 1/18; C10C 3/08

[52] U.S. Cl. ..... 208/45; 208/39; 423/447.4

[58] Field of Search ..... 208/44, 40, 22, 45, 208/39; 423/447.2, 447.4, 447.6, 449

[56] References Cited

U.S. PATENT DOCUMENTS

| | | | |
|---|---|---|---|
| 3,235,482 | 2/1966 | Knowles et al. | 208/39 |
| 3,592,595 | 7/1971 | Gump et al. | 423/447.6 |
| 3,919,387 | 11/1975 | Singer | 423/447.4 |
| 3,940,344 | 2/1976 | Yokogawa et al. | 208/44 |
| 4,184,942 | 1/1980 | Angier et al. | 208/45 |
| 4,208,267 | 6/1980 | Diefendorf et al. | 423/447.1 |
| 4,277,324 | 7/1981 | Greenwood | 423/447.4 |
| 4,277,325 | 7/1981 | Greenwood | 423/447.4 |
| 4,283,269 | 8/1981 | Greenwood | 423/447.4 |

FOREIGN PATENT DOCUMENTS

| | | | |
|---|---|---|---|
| 2614415 | 10/1976 | Fed. Rep. of Germany | 423/447.6 |
| 1356566 | 8/1971 | United Kingdom . | |

*Primary Examiner*—Delbert E. Gantz
*Assistant Examiner*—Helane E. Maull

[57] ABSTRACT

An improved process for preparing liquid crystal containing pitches includes extracting carbonaceous isotropic pitches with an organic solvent system which comprises at least one member of the group consisting of dioxane, dimethylacetamide, and tetramethylurea.

10 Claims, No Drawings

FORMATION OF OPTICALLY ANISOTROPIC PITCHES

BACKGROUND OF THE INVENTION

Optically anisotropic carbonaceous pitches are well known as useful in the formation of a wide variety of carbon artifacts. One such artifact of particular commercial interest today is carbon fiber. For convenience, particular reference will be made herein to carbon fiber technology, but it will be appreciated that the present invention has applicability in areas other than carbon fiber formation.

Carbon fibers are used in reinforcing plastic and metal matrices where the exceptional properties of the reinforcing composite materials such as their high strength to weight ratios clearly offset the general higher cost associated with their preparation. It is generally accepted that large scale use of carbon fibers as a reinforcing material would gain even greater acceptance in the marketplace if the costs associated with the formation of such fibers could be substantially reduced. As a result, the formation of carbon fibers from relatively inexpensive carbonaceous pitches has received considerable attention in recent years.

High strength, high modulus carbon fibers prepared from pitches are characterized in part by the presence of carbon crystallites which are preferentially aligned parallel to the fiber axis. The highly oriented structure of the carbon fibers has been obtained either by introducing orientation into the carbon fiber by high temperature stretching or by first forming a pitch fiber which possesses considerable anisotropy.

In forming carbon fiber from the pitch material with a high degree of orientation, it has generally been considered necessary to thermally transform the carbonaceous pitch prior to fiber formation, at least in part, to a liquid crystal or so-called mesophase state. Typically, the thermal transformation is achieved at temperatures between about 350° and about 500° C. for exceedingly long periods of time. For example, at the minimum temperature generally required to convert an isotropic pitch to the mesophase state of 350° C., at least one week of heating is usually necessary and the mesophase content of the pitch is only about 40% with the balance being isotropic material. At higher temperatures of, e.g., about 400° C., at least 10 hours of heating are usually necessary.

A wide variety of complex reaction sequences take place during the thermal treatment of isotropic pitches and these reactions result in the formation of large parallel aligned lamellar optically anisotropic molecules which are known as mesophase pitch. Small insoluble liquid spheres begin to appear in the pitch and gradually increase in size as the heating is continued. Ultimately the spheres begin to coalesce into large domains that display strong optical anisotropy, which is characteristic of parallel alignment of the liquid crystal phase. This mesophase transformation has been followed quantitatively by polarized light microscopy investigations of solvent extracted samples in which the untransformed isotropic matrix is dissolved in a solvent such as pyridine or quinoline and the insoluble mesophase fraction is recovered by filtration.

More recently, it was discovered that isotropic carbonaceous pitches contain a separable fraction which is capable of being converted very rapidly, indeed generally in less than about 10 minutes and especially in less than 1 minute when heated to temperatures in the range of about 230°–400° C., to a strong optically anisotropic deformable pitch containing greater than 75% of a liquid crystal type structure. The highly oriented anisotropic pitch material formed from only a fraction of an isotropic carbonaceous pitch has substantial solubility in pyridine and quinoline and consequently, such material is referred to as a neomesophase pitch. This process is described in U.S. Pat. No. 4,208,267.

The neomesophase fraction of pitch is isolated by solvent extraction of well known commercially available graphitizable pitches such as Ashland 240 and Ashland 260. The amount of neomesophase fraction of the pitch that is separable, however, is relatively low. For example, with Ashland 240, no more than about 10% of the pitch constitutes a separable fraction capable of being thermally converted to neomesophase. It was discovered that isotropic carbonaceous pitches could be pretreated in such a manner as to increase the amount of that fraction of the pitch which is separable and capable of being converted very rapidly to a deformable pitch containing greater than 75%, and especially greater than 90%, of a liquid crystal type structure. The pretreatment involves heating a typical graphitizable, isotropic carbonaceous pitch at an elevated temperature for a time sufficient to increase the amount of that fraction of the pitch that is capable of being converted to neomesophase and terminating such heating at a point in time when spherules visible under polarized light appear in the pitch, and preferably at a point which is just prior to the formation of the visible spherules. The pretreatment is described in detail in U.S. Pat. No. 4,184,942.

The known processes for producing the neomesophase fraction involve the step of treating a carbonaceous isotropic pitch with an organic solvent system which is characterized by having a solubility parameter at 25° C. of between about 8.0 and about 9.5. The solubility parameter has preferably been 8.7–9.2. The solubility parameter, δ, of a solvent or a mixture of solvents is given by the expression:

$$\delta = \left[ \frac{\Delta H_v - RT}{V} \right]^{\frac{1}{2}}$$

wherein $H_v$ is the heat of vaporization of the material, R is the molecular gas content, T is the temperature in degrees Kelvin and V is the molar volume. In this regard, see, for example, J. Hildebrand and R. Scott, "Solubility of Non-Electrolytes", 3rd Ed., Reinhold Publishing Company, New York (1949) and "Regular Solution", Prentice Hall, New Jersey (1962). Typical solubility parameters at 25° C. are 9.0 for benzene, 8.7 for xylene and 8.2 for cyclohexane. Heretofore, the preferred solvent has been toluene which has a solubility parameter of 8.8.

It has now been surprisingly discovered that certain solvents whose solubility parameter is greater than 9.5 or solvent systems based thereon can be used in place of the organic solvent systems having a solubility parameter of between about 8.0–9.5.

Accordingly, it is the object of this invention to provide a process for producing an optically anisotropic pitch with an organic solvent system whose solubility parameter is greater than 9.5. This and other objects of the invention will become apparent to those skilled in the art from the following detailed description.

SUMMARY OF THE INVENTION

This invention relates to the formation of carbonaceous pitches and more particularly to the formation of carbonaceous pitches involving the step of treating a carbonaceous isotropic pitch with an organic solvent system comprising at least one member of the group consisting of dioxane, dimethylacetamide, and tetramethylurea. Under certain circumstances chloropyridine could be utilized but its cost renders its general use prohibitive.

DESCRIPTION OF THE INVENTION

The term "pitches" used herein includes petroleum pitches, coal tar pitches, natural asphalts, pitches obtained as by-products in the naphtha cracking industry, pitches of high carbon content obtained from petroleum, asphalt, and other substances having properties of pitches produced as byproducts in various industrial production processes. The term "petroleum pitch" refers to the residuum carbonaceous material obtained from distillation of crude oils and from the catalytic cracking of petroleum distillates. "Coal tar pitch" refers to the material obtained by distillation of coal, while "synthetic pitches" generally refers to residues obtained from the distillation of fusible organic substances.

Generally, pitches having a high degree of aromaticity are suitable for carrying out the present invention. Indeed, aromatic carbonaceous pitches having carbon contents of from about 88% to about 96% by weight and a hydrogen content of about 12% by weight to about 4% by weight are generally useful in the process of this invention. While elements other than carbon and hydrogen sources such as sulfur and nitrogen, to mention a few, are normally present in such pitches, it is important that these other elements do not exceed 4% by weight of the pitch, and this is particularly true in forming carbon fibers from these pitches. Also, these useful pitches typically will have a molecular weight distribution ranging from about 300 to 4000.

Another important characteristic of the starting pitches employed in this invention is that these pitches generally have less than 3 wt%, preferably less than 0.3 wt%, and most preferably less than 0.1 wt%, quinoline insolubles (hereinafter QI), such as coke, carbon black, and the like. The QI of the pitch is determined by the standard technique of extracting the pitch with quinoline at 75° C. In the starting pitches, the QI fraction typically consists of coke, carbon black, ash or mineral matter found in the pitches. In forming carbon articles, particularly in forming carbon fibers, it is particularly important that the amount of foreign materials, such as coke and carbon black, be kept at an absolute minimum; otherwise, such foreign matter tends to introduce weaknesses in the fibers and deformities or other irregularities in the carbon articles prepared when using starting pitches having greater than 0.1% foreign materials.

Those petroleum pitches and coal tar pitches which are well known graphitizable pitches have the foregoing requirements and are preferable starting materials for practicing the present invention. Commercially available isotropic pitches particularly commercially available natural isotropic pitches which are known to form a mesophase pitch in substantial amounts, for example, in the order of 75% to 95% by weight during heat treatment, are especially preferred inexpensive starting materials in the practice of this invention.

The pitches have a solvent soluble separable fraction which is referred to as a neomesophase former fraction or "NMF" fraction which is capable of being converted to an optically anisotropic pitch containing greater than 75% of a highly oriented pseudocrystalline material referred to as a neomesophase pitch. Importantly, this conversion is achievable in generally less than 10 minutes and especially in less than 1 minute when the NMF fraction is heated to temperatures in the range of from about 230° C. to about 400° C., and especially about 30° C. above the point where the material becomes liquid.

Thus, a typical graphitizable isotropic pitch having below about 5 wt% QI (i.e., coke, carbon minerals, and the like) and most preferably below about 0.1 wt% QI, is heated at temperatures in the range of about 350° C. to temperatures generally of about 450° C., and certainly no greater than 500° C., for a time at least sufficient to increase the amount of neomesophase former fraction in the pitch and terminating the heating at a point in time when a portion of the pitch is transformed into spherules which are visible under polarized light microscopic examination. Indeed, it is particularly preferred that heating of the pitch be terminated just prior to the point in time in which spherules of liquid crystals would begin to be formed in the isotropic pitch, were heating continued.

Clearly the preferred heating range will depend upon numerous factors including the composition and nature of the graphitizable isotropic pitch being heated. Generally, such typical carbonaceous isotropic pitches will not produce the observable spherules at temperatures below 350° C. As temperatures are increased, however, above 350° C., particularly, for example, temperatures above 450° C., and indeed temperatures as high as 550° C., carbonization can occur. If fibers are going to be produced from the pitch being treated in accordance with the present invention, it is preferred not to have such carbon particles present. Consequently, the ideal temperature range for heating such carbonaceous pitch will be in the range of about 350° C. to about 480° C. Heating can be conducted at ambient pressures, although reduced pressures, for example pressures of about 1 psi to atmospheric pressure, may be employed. So, too, may elevated pressure be employed. Indeed, higher pressures than atmospheric may be used; however, it is particularly preferred to conduct said heating at temperatures in the range of about 380° C. to 450° C. and at pressures in the range of about 1 psi to 20 psi.

As will be readily appreciated, the length of time for heating the carbonaceous pitch will vary depending upon the temperature, pressure, and indeed the composition of the pitch itself. However, for any given pitch the ideal length of time for heating the pitch can be determined by making a series of micrographic observations of a number of samples of the pitch heated isothermally for different time periods and determining at what point mesophase spherules can be observed visually under polarized light at a magnification factor of from 10 to 1000 X. Such pitch can always then thereafter be heated at that temperature range for that length of time or shorter.

It is particularly preferred to terminate the heating of the pitch at a point in time just short of the transformation of the pitch into spherules which are observable by polarized microscopy. In general, the pitch is heated for from about 1 hour to about 20 hours. For example, with a commercially available carbonaceous isotropic pitch such as Ashland 240, such pitch will be heated for about 1 to 16 hours at temperatures of about 400° C. before the formation of visible spherules, depending on the amount of the pitch.

The foregoing process of heating the carbonaceous pitch results in an increase in the neomesophase former fraction of the pitch. Such heating is terminated, however, prior to the formation of a substantial quantity of phase separated mesophase material in the pitch. Thereafter, the heat treated pitch is extracted with organic solvents to separate the neomesophase former fraction.

Extraction of the pitch can be conducted at elevated temperatures or at ambient temperatuers. Generally, the pitch is first permitted to cool to ambient temperatures.

In accordance with the present invention, the pitch is extracted with an organic solvent system which comprises at least one member of the group consisting of dioxane, dimethylacetamide, and tetramethylurea. These organic solvents have a solubility parameter which is greater than 9.5° at 25° C. In particular, the solubility parameter of dioxane is 10.0, dimethylacetamide is 11.1 and tetramethylurea is 10.6.

In some instances the organic solvent system of this invention may also contain significant amounts of the known solvents mentioned above and having solubility parameters at 25° C. of between about 8.0 and about 9.5. Such cosolvents are preferably toluene, benzene, xylene and cyclohexane. The use of toluene being especially preferred. Moreover, the mixed solvent system may further contain an aliphatic hydrocarbon, e.g. heptane, as described in U.S. Pat. No. 4,208,267.

The pitch is treated with sufficient solvent to dissolve at least a portion of the isotropic pitch and leave a solvent insoluble fraction of the pitch at ambient temperatures, such as, for example, about 25°-30° C. In a typical procedure, about 5-150 ml, preferably about 10-20 ml, of solvent per gram of isotropic graphitized pitch will be employed to provide a NMF fraction with preferred properties.

The preferred properties of the NMF fraction are a C/H ratio greater than 1.4, and preferably between about 1.60-2.0. Typically, the preferred separated fraction will have a sintering point (i.e., a point at which phase change can first be noted by differential thermal analysis of the sample in the absence of oxygen) below 350° C., and generally in the range of from about 320°-340° C.

The choice of solvent or solvents employed, temperatures of extraction, and the like will effect the amount and exact nature of the NMF separated and therefor, the precise physical properties will vary. In carbon fiber formation, it is especially preferred that the insoluble fraction be that which will, upon heating to about 230°-400° C., be converted to an optically anisotropic pitch containing greater than 75%, and preferably greater than 90%, neomesophase.

Prior to contacting the isotropic pitch with the solvent to isolate and separate the neomesophase form of fraction of the pitch, it is preferred to mechanically or otherwise comminute the pitch into smaller particles on the order of less than 100 Taylor screen mesh size. This can be accomplished by such techniques as grinding, hammer milling, ball milling and the like.

The NMF fraction is converted to an anisotropic pitch containing greater than 75% neomesophase in a time period generally less than about 10 minutes. Hence, carbon articles such as fibers can be readily prepared in accordance with the present invention at temperatures which range from about 230°-400° C. whereby at least 75% neomesophase pitch is formed in times of less than about 10 minutes and thereafter forming the resulting high neomesophase containing pitch into a shaped article such as fibers, and subjecting the shaped article to an oxidizing atmosphere at temperatures in the range of about 200°-350° C. to render the article infusible. Thereafter the fibers can be carbonized by heating in an inert atmosphere at elevated temperatures in the range of, for example, about 800°-2800° C., preferably about 1000°-2000° C., for a time sufficient to carbonized the fibers.

In order to more fully set forth the process of the present invention, various examples are given below. These examples are meant to be illustrative only, and as used throughout this specification and claims all temperatures are in degrees centigrade and all parts and percentages are by weight, unless otherwise indicated.

EXAMPLE 1

A commercially available petroleum pitch, Ashland 240, was ground, sieved (100 Taylor mesh size) and extracted with dioxane at 28° C. in a ratio of 1 gram of pitch per 100 ml of dioxane. 87.4% of the pitch dissolved leaving an insoluble fraction of 12.6%.

The dioxane insoluble fraction was separated by filtration and dried.

The dried neomesophase fraction is charged into a spinning die provided with rotor extending coaxially into a cylindrical die cavity under a nitrogen atmosphere. The rotor has a conical tip of substantially the same contour of the die cavity and a concentric channel substantially equal to the diameter of the die orifice. The charge is heated at a rate of 10° C. per minute to 380° C. and then the rotor is driven at speed from 50-2000 rpm. Good continuous fibers are then spun under a nitrogen pressure of about 5 psi and subjected to an oxidation step by heating from room temperature to 280° C. in air at a rate of 15° C. per minute and holding the fiber at 280° C. for 20 minutes. Thereafter the fibers are heated in an inert nitrogen atmosphere at 1000° C.

EXAMPLE 2

Example 1 was repeated except that dimethylacetamide is used in place of the dioxane. The solvent insoluble fraction was 5% of the pitch so treated.

EXAMPLE 3

Example 1 was repeated except that dimethylacetamide was employed at a concentration of 100 grams per liter. The resulting insoluble fraction, after filtration and drying, was found to be essentially 100% mesophase.

Various changes and modifications can be made in the process of this invention without departing from the spirit and scope thereof. The various embodiments which have been described herein were for the purpose of further illustrating the invention but were not intended to limit it.

What is claimed is:

1. In a process for producing an optically anisotropic deformable pitch by extracting a carbonaceous isotropic pitch, prior to fiber formation therefrom, with an organic solvent system to form a solvent insoluble fraction which is then separated from the resulting organic solvent system fraction; and heat treating said insoluble fraction the improvement which comprises employing as said organic solvent system at least one member of the group consisting of dioxane, and tetramethylurea.

2. The process of claim 1 wherein said organic solvent system is used in an amount sufficient to produce a solvent insoluble fraction having a sintering point below about 350° C. when determined by differential thermal analysis of a sample of the insoluble fraction in the absence of oxygen.

3. The process of claim 2 wherein said organic solvent system is used in an amount sufficient to provide a solvent insoluble fraction having a sintering point in the range of about 300°–340° C.

4. The process of claim 1 wherein the isotropic pitch is treated with about 5–150 ml of said organic solvent system per gram of pitch at ambient temperature.

5. The process of claim 1 wherein the solvent insoluble fraction is heated to a temperature of about 230°–400° C. whereby said fraction is converted to a deformable pitch containing greater than 75% of an optically anisotropic phase and which phase when extracted with quinoline at 75° C. contains less than about 25 wt. % of substances insoluble in said quinoline.

6. The process of claim 5 wherein the heating of said solvent insoluble fraction is effected while extruding the said heated insoluble fraction through an extrusion orifice thereby forming a pitch fiber.

7. The process of claim 1 wherein said isotropic carbonaceous pitch is heated at a temperature in the range of about 350°–450° C. for a time sufficient to increase the solvent insoluble fraction of the pitch before contact with said organic solvent system.

8. The process of claim 7 wherein said preheating is terminated just prior to the time when spherules become visible upon polarized light microscopic examination of samples of the pitch.

9. The process of claim 1 wherein said solvent system comprises dioxane.

10. The process of claim 1 wherein said solvent system comprises tetramethylurea.

* * * * *